US007053561B2

(12) United States Patent
Mayer et al.

(10) Patent No.: US 7,053,561 B2
(45) Date of Patent: May 30, 2006

(54) CIRCUIT APPARATUS AND METHOD FOR OPERATING A LAMP

(75) Inventors: Siegfried Mayer, Moosinning (DE); Arwed Storm, Dachau (DE)

(73) Assignee: Patent Treuhand Gesellschaft fur elecktrische Gluhlampen mbH, Munich (DE)

( * ) Notice: Subject to any disclaimer, the term of this patent is extended or adjusted under 35 U.S.C. 154(b) by 38 days.

(21) Appl. No.: 10/624,575

(22) Filed: Jul. 23, 2003

(65) Prior Publication Data

US 2004/0245942 A1 Dec. 9, 2004

(30) Foreign Application Priority Data

Aug. 1, 2002 (DE) ..... 102 35 217

(51) Int. Cl.
*H05B 37/02* (2006.01)
*H05H 7/00* (2006.01)

(52) U.S. Cl. ..... 315/209 R; 315/DIG. 7

(58) Field of Classification Search ..... 315/291, 315/224, 307, DIG. 5, DIG. 7, 225, 194, 315/209 R See application file for complete search history.

(56) References Cited

U.S. PATENT DOCUMENTS

| | | | | |
|---|---|---|---|---|
| 5,589,740 | A * | 12/1996 | Rudolph et al. | 315/291 |
| 5,825,136 | A | 10/1998 | Rudolph | 315/307 |
| 5,831,396 | A | 11/1998 | Rudolph | 315/307 |
| 6,057,611 | A * | 5/2000 | Reiser | 307/125 |
| 6,194,845 | B1 * | 2/2001 | Konopka et al. | 315/291 |
| 6,246,173 | B1 * | 6/2001 | Fischer et al. | 331/117 FE |
| 6,259,213 | B1 * | 7/2001 | Rudolph | 315/209 R |
| 6,424,101 | B1 * | 7/2002 | Sabate | 315/307 |

* cited by examiner

*Primary Examiner*—Trinh V Dinh
*Assistant Examiner*—Minh Dieu A

(57) ABSTRACT

The current through the components of a half-bridge of an electronic ballast is intended to be limited during the starting phase. For this purpose, the gate of a half-bridge transistor (T2) is driven by a current limiting circuit (D1, D2, D3, T3, C3) in such a way that the current through the transistors (T1, T2) is limited during the starting phase, whereas it remains unlimited during the glow phase and burning phase of the lamp (LA).

3 Claims, 4 Drawing Sheets

CIRCUIT APPARATUS AND METHOD FOR OPERATING A LAMP

TECHNICAL FIELD

The present invention relates to a circuit apparatus for operating a lamp, in particular a low-pressure discharge lamp, having an inverter device, which has at least one transistor switching unit, for supplying the lamp with alternating current, and a current limiting device, which is connected to the at least one transistor switching unit, for limiting the current through the transistor switching unit. The present invention also relates to a corresponding method for operating a lamp.

BACKGROUND ART

Low-volt discharge lamps are typically operated with the aid of an electronic ballast (EVG). The alternating current required for operating the lamp is generally generated in the ballast by means of known half-bridge inverters. The half-bridge is used to operate a load circuit that comprises one or more lamps. The load circuit comprises inductive and capacitive elements, the result being a prescribed load circuit resonant frequency.

Depending on the circuit concept, in the case of self-oscillating resonant circuits operation at the resonant frequency is set up during idling, that is to say in the starting phase of the lamp in the case of an EVG. In this case, the resonant current is determined solely by the Q factor of the resonant circuit. This leads to a very high component loading in the case of a high Q factor, since very high currents occur.

The starting voltage for starting a lamp by means of a resonant circuit, and the reactive current, associated therewith, before the starting can be limited only by the saturation behavior of the resonance inductor or by reduction of the Q factor of the resonant circuit. Consequently, to date, the no-load voltage has been limited by a resonant inductor whose saturation has deliberately been selected to be low. This measure leads to an additional increase in the resonant current. The limitation of the current is performed by a Q factor of the resonant circuit that is deliberately worsened in some circumstances. This worsening takes place, however, to the detriment of the efficiency and is practicable only for equipment of relatively low power.

A further-developed current limitation is disclosed in European Patent EP 0 798 952 B1. In the EVG described there, the control path of a transistor is arranged in emitter line of one of the inverter transistors. The effective emitter resistance of the inverter transistor is varied continuously as a function of the voltage drop across one of the resonant circuit components via the variable conductivity of this control section, and the clock frequency of the inverter is thereby increased so far that a reduction in the no-load voltage in the resonant circuit is achieved in conjunction with current limitation because of the now stronger detuning with respect to the resonant frequency of the resonant circuit.

A similar current limiting circuit is disclosed in European Patent Application EP 0 800 335 A2. An auxiliary transistor is connected in each case in the control loops of the half-bridge inverter transistors such that the emitter resistance of each half-bridge inverter transistor is formed by a parallel circuit that comprises at least one ohmic resistance and the control path, arranged parallel thereto, of the corresponding auxiliary transistor. It is thereby possible for the effective emitter resistance or the feedback of the half-bridge inverter to be switched over as a function of the operating phases of the lamp, and so for the clock frequency of the half-bridge inverter to be varied in a simple way within wide limits by the dimensioning of the resistances of the parallel circuit according to the invention. Here, as also in the previous case, the auxiliary transistor is controlled by the lamp voltage, which in turn controls the emitter line of a half-bridge transistor.

DISCLOSURE OF THE INVENTION

The object of the present invention consists in proposing an improved type of current limitation by a transistor unit of an inverter device for operating lamps.

According to the invention, this object is achieved by means of a circuit apparatus for operating a lamp, in particular a low-pressure discharge lamp, having an inverter device for supplying the lamp with alternating current, which has at least one transistor switching unit, and a current limiting device, which is connected to the at least one transistor switching unit, for limiting the current that flows through the at least one transistor switching unit, it being possible for the control electrode of the at least one transistor switching unit to be driven by the current limiting device for the purpose of current limitation.

Furthermore, the abovenamed object is achieved according to the invention by a method for operating a lamp, in particular a low-pressure discharge lamp, by generating an alternating current for supplying the lamp by means of at least one transistor switching unit and limiting the current through the at least one transistor switching unit, the control electrode of the at least one transistor switching unit being driven for the purpose of current limitation.

The inverter device can comprise a half-bridge composed of the at least one transistor unit and a further transistor unit. The inverter can thereby be produced very cost-effectively from only two active components. The transistor units can consist in each case, if appropriate, of MOSFET transistors.

The lamp is preferably operated in a load circuit that is connected to the inverter device. This load circuit preferably comprises an LC resonant circuit for operating the lamp with a defined resonant frequency, as well as a coupling capacitor for suppressing direct current components.

For the purpose of a more cost-effective design, the circuit apparatus comprises a phase setting device, connected to the inverter device, in order to match the operating frequency of the inverter device to a resonant frequency of the load circuit. It is therefore possible to achieve a voltage rise necessary for the starting operation. The phase setting device can be connected for this purpose to a control electrode of the at least one transistor switching unit such that the switching operation in the transistors of the inverter device is matched to the load circuit resonance.

The current limiting device advantageously is connected in parallel with the phase setting device at the control electrode of a transistor of the inverter device. The amplitude of the lamp current is thereby regulated via the control electrode of the transistor by matching the switching rate.

It is further advantageous when the current limiting device comprises a switching device by means of which the at least one transistor switching unit can be switched off as a function of the current through the at least one transistor switching unit. It is thus possible, for example, to make use, as such a switching device, of a transistor that in turn switches the transistor switching unit of the inverter device on or off.

BRIEF DESCRIPTION OF THE DRAWINGS

The present invention will now be explained in more detail with the aid of the attached drawings in which.

BEST MODE FOR CARRYING OUT THE INVENTION

The exemplary embodiments described below constitute preferred embodiments of the present invention.

Figure 1:
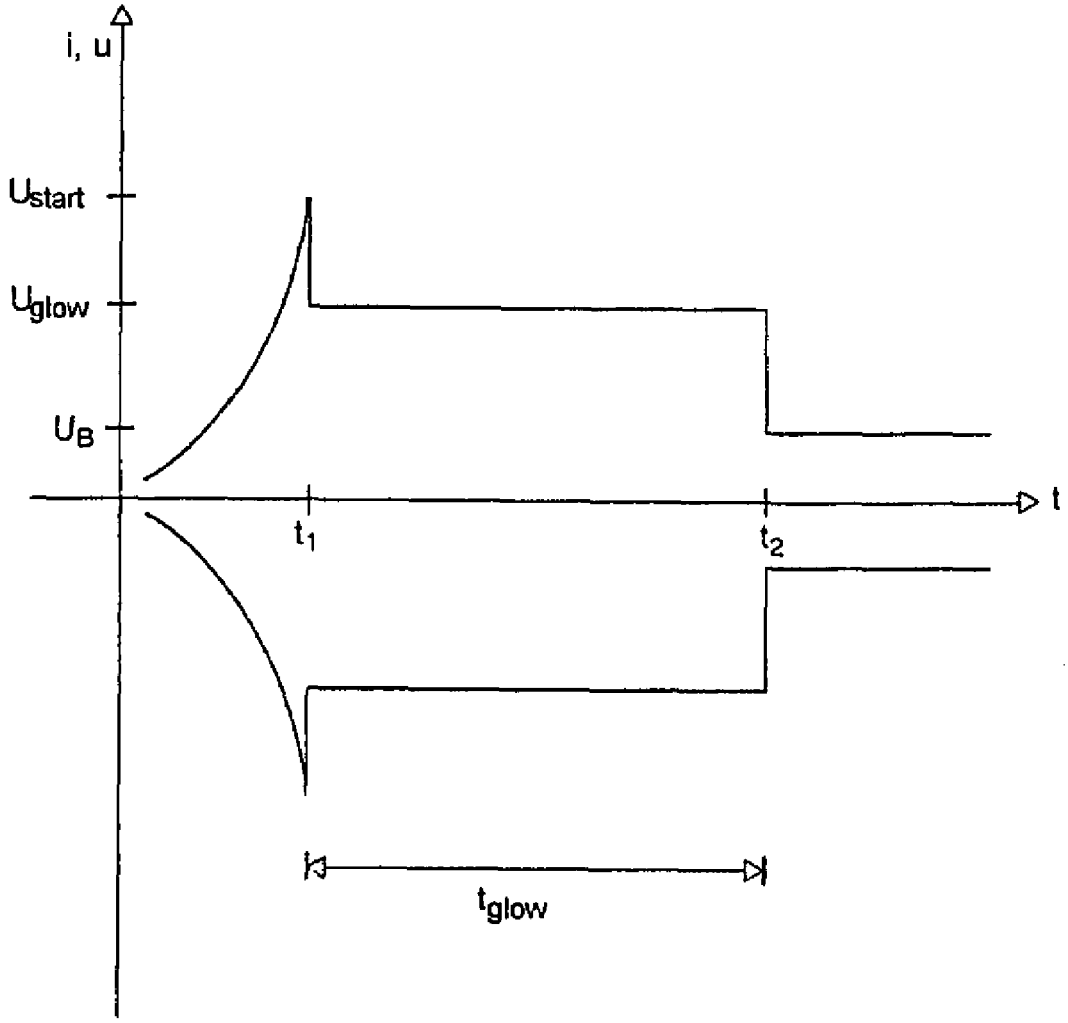
FIG. 1 shows the envelope of the voltage characteristic for a lamp with an electronic ballast.

In order to explain the invention, FIG. 1 illustrates the characteristic of the envelope of the voltage during starting of low-pressure discharge lamps. After the switching-on operation, the voltage rises as far as the value at which the respective lamp starts. This value is reached at the instant t1. The starting phase is generally concluded in less than one millisecond. After the starting, the voltage across the lamp drops to the level of the glow discharge. The glow phase can exceed times of one second when filaments are not preheated. The voltage level during the glow discharge is substantially above the level during operation at nominal value UB. At the instant t2, the lamp voltage drops to the operating level. Should the lamp not change to operation at nominal value in a time tglow,max, the safety shutdown of the equipment likewise responds in order to protect the components.

Figure 2:
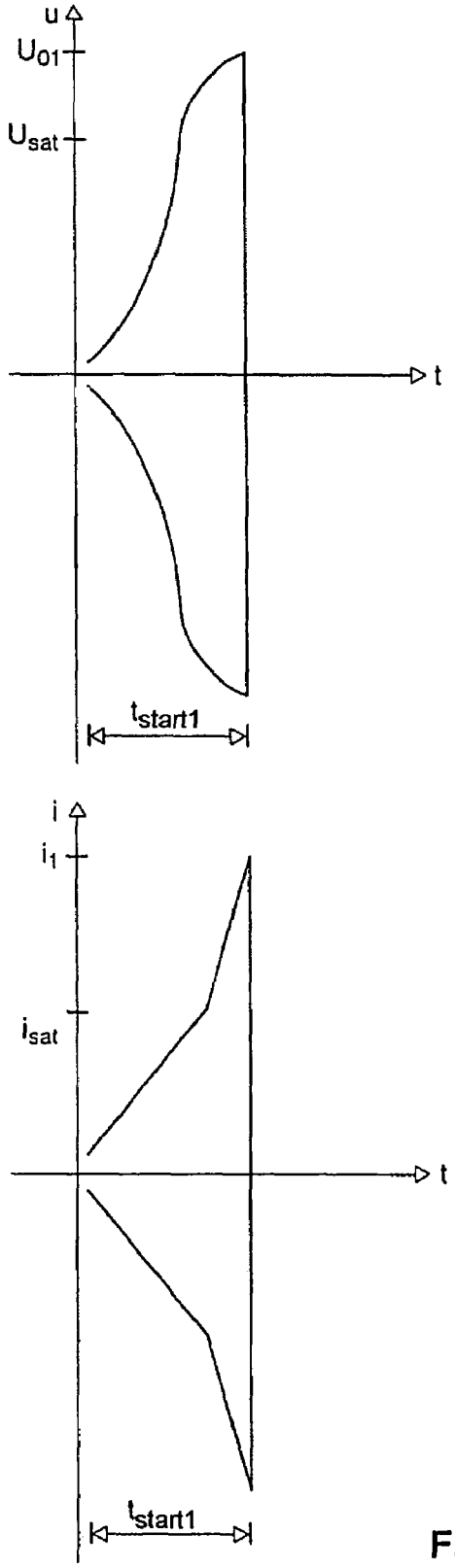
FIG. 2 shows the envelope of the current and voltage characteristics for a lamp with an electronic ballast in accordance with the prior art.

If the lamp does not start, a protective circuit switches off the electronic ballast (see FIG. 2). This serves to protect the half-bridge or inverter transistors, since these can conduct the high current only for a short time interval tstart without permanent damage. The time intervals tstart and tglow,max are generally interrelated in terms of circuitry and so a short time tstart dictated by protection also limits the glow phase. Furthermore, the electronic ballast must ensure that the no-load voltage UO does not exceed a limiting value laid down in the safety standards. Minimizing the component loading by means of low currents and thereby being able to implement a long glow phase are decisive for reliable starting and a good lamp lifetime. At the same time, the no-load voltage U0 must be limited to favorable values within the safety standards. In conventional circuits, the starting voltage is limited by a deliberate reduction in the saturation limit of the resonance inductor. However, this measure leads to high currents in the inverter. The onset of saturation in the current i and in the voltage u are denoted, respectively, by isat and Usat in FIG. 2.

Figure 3:
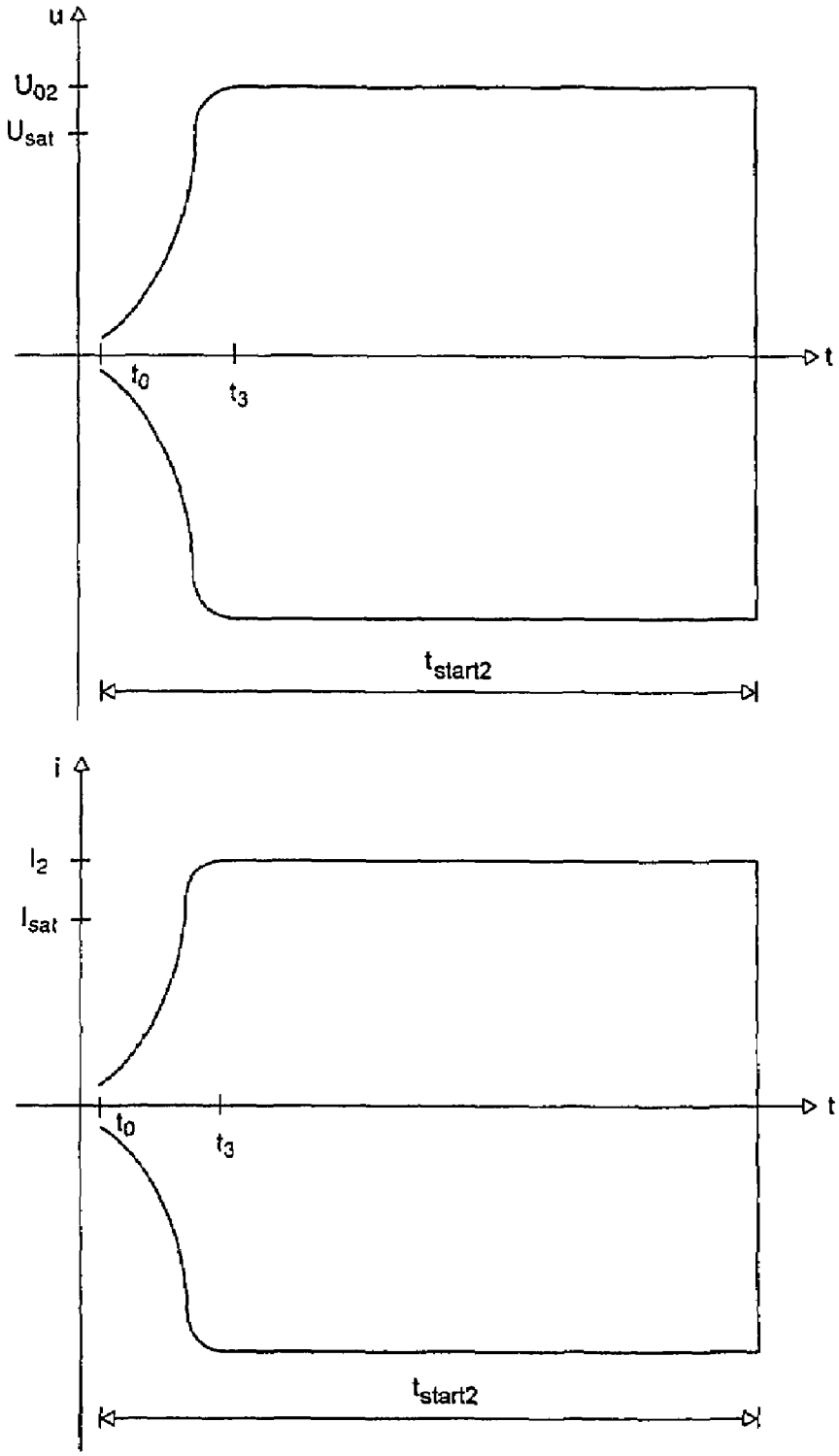
FIG. 3 shows the envelope of the current and voltage characteristics for a lamp with an electronic ballast according to the invention.

Consequently, according to the invention the starting voltage is reduced in the starting phase in such a way that the current in the half-bridge drops and the starting phase can be lengthened substantially without damage to the electronic ballast. This lengthening is indicated in FIG. 3. Here, as well, the voltage firstly rises to U02 after the switch-on. This value is substantially below the value of U01 in accordance with the prior art. Because of the nonlinear relationship between current and voltage, the current through the transistors rises only to I2 in conjunction with the limitation to U02. This substantial current reduction permits a likewise substantial lengthening of the maximum duration of the starting phase. The transistors typically used therefore incur no damage even after tstart2, since they are flowed through only by a current of I2. After tstart2, at the latest, the electronic ballast is switched off if the lamp does not start. However, if the lamp starts at the latest at the instant tstart2, the voltage drops here, as well, to the glow voltage of Uglow. The starting time, greatly lengthened by comparison with tstart1, also permits a proportionally lengthened glow phase tglow,max, and lamps with glow phases of over a second can be started reliably.

Figure 5:
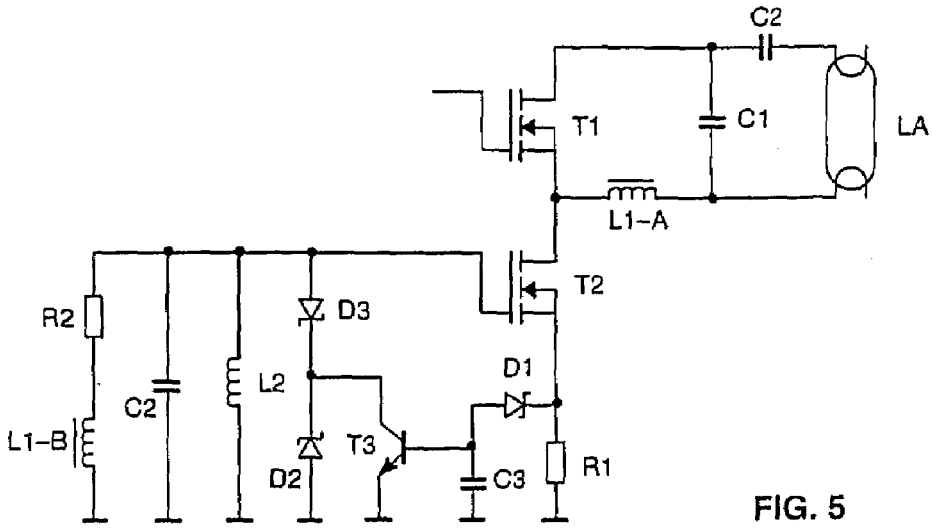
FIG. 5 shows a circuit diagram relating to a circuit apparatus according to the invention.

The circuit arrangement illustrated below in conjunction with FIG. 5 leads through feedback to the desired current limitation in conjunction with an increased lamp efficiency. The circuit in FIG. 5 shows a lamp LA. It is formed by a half-bridge comprising the MOSFET transistors T1 and T2 and the capacitor C1. The two transistors T1 and T2 are connected in series, while the capacitor C1 is connected in parallel with the transistor T1. An inductor L1-A is connected between the tie point of the two transistors T1 and T2 and the capacitor C1. Together with the capacitor C1, it forms a resonant circuit that prescribes the idling frequency or the frequency in the starting phase. The lamp LA is connected in parallel with the capacitor C1, there being arranged between one electrode of the lamp LA and one electrode of the capacitor C1 a coupling capacitor C2 that filters direct components out of the power supply. The properties of the load circuit of the half-bridge are therefore determined by the components L1-A, C1 and C2 in addition to the lamp LA.

The transistor T2 is connected to ground via a resistor R1. In addition to other control tasks, this resistor R1 serves the purpose of preventing a so-called resonance catastrophe, in case of which very high currents arise, by detuning the resonant circuit L1, C1.

A so-called phase setting circuit is connected between the gate of the transistor T2 and ground. The effect of this phase setting circuit is to match the frequency of the half-bridge to the resonant frequency of the load circuit. The phase setting circuit comprises a parallel circuit of a resistor R2, a capacitor C2 and a coil L2. The phase rotation results from the dimensioning of the reactances C2 and L2. Reference may be made to European Patent EP 0 781 077 B1 with regard to the phase setting circuit.

The control voltage for the gate of the transistor T2 is generated by a coil L1-B that is magnetically coupled to the coil L1-A and thereby couples the voltage generated by the half-bridge into the gate circuit of the transistor 2 in order to control the latter. The coil L1-B is connected for this purpose between the resistor R2 and ground.

The aim is now to control the transistor T2 via its gate such that the current flowing through it does not exceed a certain threshold value. Use is made for this purpose of the bipolar transistor T3 whose base is controlled with the aid of the voltage dropping across the resistance R1. Connected between the base of the transistor T3 and the resistor R1 is a Zener diode D1 that acts, together with a capacitor C3, connected between the base of the transistor T3 and ground, to the effect that the transistor T3 is active only in a relatively high current range, that is to say during the starting phase, and the transistor T2 is switched off early, if appropriate, in each switching cycle. This increases the switching rate. In the event of relatively low voltages, that is to say during the glow phase and burning phase, the transistor T3 is not activated, and so neither is the transistor T2 of the half-bridge switched off for the purpose of current limitation. The emitter of the transistor T3 is connected to ground, and the collector is connected to the midpoint of two Zener diodes D2 and D3 that are connected in parallel with the phase setting circuit, that is to say between the gate of the transistor T2 and ground.

Figure 4:
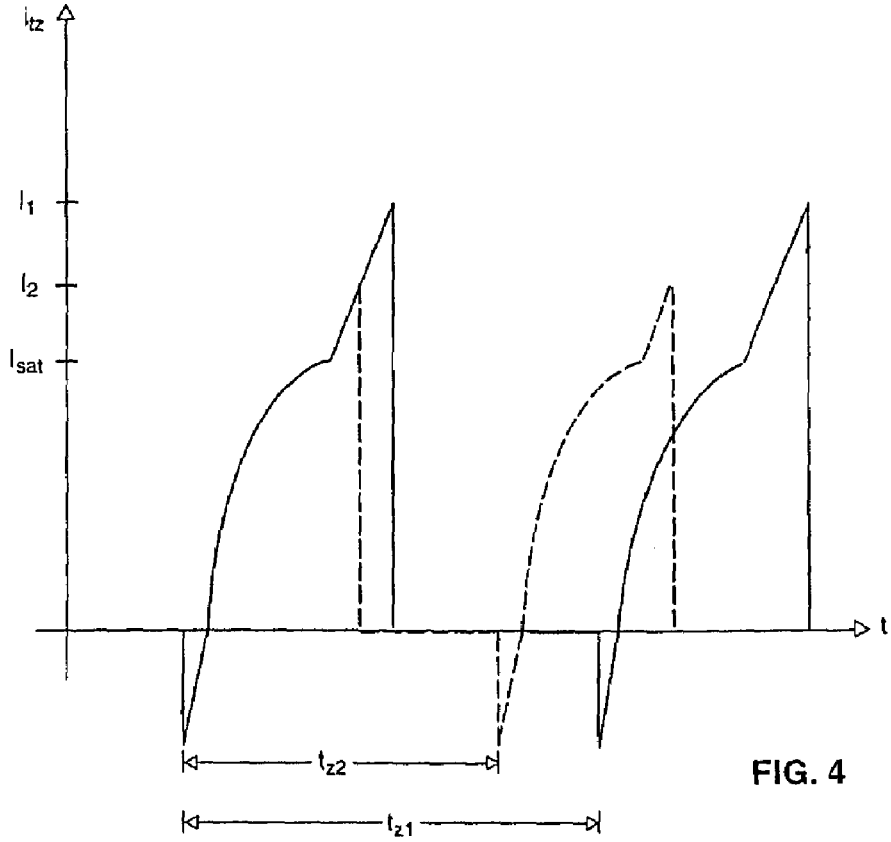
FIG. 4 shows the current characteristic across the switching transistor of the inverter within a switching cycle.

FIG. 4 shows the current in the MOSFET transistor T2 in the starting phase. A continuous line describes the current characteristic without current limitation, while a dashed line describes the current characteristic with current limitation according to the invention. The frequency increase of the half-bridge is achieved by early switching off at the operating point 12. The cycle duration tz1 without a limiting circuit is substantially longer than the cycle duration tz2 with a limiting circuit. The capacitor C3 is inserted so that the switching-off transistor T3 does not operate in the linear range, and that the MOSFET transistor T2 is switched off completely. After the starting of the lamp LA and a subsequent glow phase, the current through the transistor T2 drops substantially below the operating point 12, and so the current limiting circuit is no longer involved in the continuous operation of the lamp.

Viewed overall, therefore, in the case of the circuit according to the invention the operating frequency of the half-bridge is matched by the phase setter R2, C2, L2, to the resonant frequency of the load circuit L1-A, C1, C2, LA, and the current flowing through the transistor T2 is limited during the starting phase via the gate of the transistor, T2 by the current limiting circuit D1, D2, D3, T3, C3.

The gate of the transistor T1 is likewise driven by a phase setting circuit, and the control voltage is also generated by a magnetically coupled inductor. A current limiting circuit such as is used for driving the gate of the transistor T2 need not be employed to drive the gate of the transistor T1, since the discharge current from the coil L1-A is automatically limited if the charging current was limited. This can be derived straight away from the energy balance of the coil L1-A.

As already indicated, the effect of the current limitation by the appropriate control of the gate of the transistor 2 is that the current through the transistors T1 and T2 is limited such that their service life is substantially increased, and the starting phase can be lengthened. The circuit according to the invention can therefore also be used to start lamps that have a substantially longer starting phase than the maximum duration of the starting phase of conventional electronic ballasts.

The invention claimed is:

1. A circuit for operating a discharge lamp (LA), the circuit comprising:

an inverter (T1,T2) for supplying the lamp with alternating current, the inverter having an operating frequency, the inverter comprising:

at least one transistor switching unit (T2) having a gate; and a current limiting device (T3,D1,D2,D3,C3) coupled to the gate of the at least one transistor switching unit (T2), wherein the current limiting device is operable to switch the at least one transistor unit on and off as a function of a current flowing through the at least one transistor unit;

a load circuit (L1-A,C1,C2) connected between the inverter and the lamp, the load circuit having a resonant frequency; and a phase setting device (R2,C2,L2) connected to the gate of the at least one transistor switching unit (T2), the phase setting device being operable to match the operating frequency of the inverter to the resonant frequency of the load circuit.

2. A circuit for operating a discharge lamp (LA), the circuit comprising:

an inverter (T1,T2) for supplying the lamp with alternating current, the inverter having an operating frequency, the inverter comprising:

at least one transistor switching unit (T2) having a gate; and a current limiting device (T3,D1,D2,D3,C3) coupled to the gate of the at least one transistor switching unit (T2), wherein the current limiting device is operable to switch the at least one transistor unit on and off as a function of a current flowing through the at least one transistor unit; and wherein:

the at least one transistor switching unit (T2) is connected to ground via a first resistor (R1); and the current limiting device comprises:

a switching device (T3) having a base, an emitter, and a collector, wherein the emitter is connected to ground;

a capacitor (C3) coupled between the base of the switching device (T3) and ground;

a first zener diode (D2) coupled between the first resistor (R1) and the base of the switching device (T3);

a second zener diode (D2) coupled between the collector of the switching device (T3) and ground; and a third zener diode (D3) coupled between the gate of the at least one transistor switching unit (T2) and the collector of the switching device (T3).

3. A circuit for operating a discharge lamp (LA), the circuit comprising:

an inverter (T1,T2) for supplying the lamp with alternating current, the inverter having an operating frequency, the inverter comprising:

at least one transistor switching unit (T2) having a gate; and a current limiting device (T3,D1,D2,D3,C3) coupled to the gate of the at least one transistor switching unit (T2), wherein the current limiting device is operable to switch the at least one transistor unit on and off as a function of a current flowing through the at least one transistor unit; and wherein:

the at least one transistor switching unit (T2) is connected to ground via a first resistor (R1); and the current limiting device comprises:

a switching device (T3) having a base, an emitter, and a collector, wherein the emitter is connected to ground;

a capacitor (C3) coupled between the base of the switching device (T3) and ground;

a first zener diode (D1) coupled between the first resistor (R1) and the base of the switching device (T3);

a second zener diode (D2) coupled between the collector of the switching device (T3) and ground; and a third zener diode (D3) coupled between the gate of the at least one transistor switching unit (T2) and the collector of the switching device (T3);

a load circuit (L1-A,C1,C2) connected between the inverter and the lamp, the load circuit having a resonant frequency; and a phase setting device (R2,C2,L2) connected to the gate of the at least one transistor switching unit (T2), the phase setting device being operable to match the operating frequency of the inverter to the resonant frequency of the load circuit.

* * * * *